US010113423B2

(12) United States Patent
Haisler et al.

(10) Patent No.: US 10,113,423 B2
(45) Date of Patent: Oct. 30, 2018

(54) SYSTEMS AND METHODS FOR MONITORING A FLUID SYSTEM OF A MINING MACHINE

(71) Applicant: Harnischfeger Technologies, Inc., Wilmington, DE (US)

(72) Inventors: Michael Haisler, Waterford, WI (US); Shashi Gudur, Oak Creek, WI (US); Anubhaw Bhushan, Oak Creek, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 0 days.

(21) Appl. No.: 14/183,194

(22) Filed: Feb. 18, 2014

(65) Prior Publication Data

US 2014/0236432 A1 Aug. 21, 2014

Related U.S. Application Data

(60) Provisional application No. 61/766,080, filed on Feb. 18, 2013.

(51) Int. Cl.

| | |
|---|---|
| ***E21C 35/04*** | (2006.01) |
| ***E02F 9/20*** | (2006.01) |
| ***E21C 47/00*** | (2006.01) |
| ***E02F 9/26*** | (2006.01) |

(52) U.S. Cl.

CPC ..... *E21C 35/04* (2013.01); *E02F 9/2054* (2013.01); *E02F 9/267* (2013.01); *E02F 9/268* (2013.01); *E21C 47/00* (2013.01); *F15B 2211/50* (2013.01)

(58) Field of Classification Search

None

See application file for complete search history.

(56) References Cited

U.S. PATENT DOCUMENTS

| | | | | |
|---|---|---|---|---|
| 4,755,110 | A * | 7/1988 | Bauer et al. | 417/364 |
| 5,347,448 | A | 9/1994 | Nam | |
| 5,381,874 | A | 1/1995 | Hadank et al. | |

(Continued)

FOREIGN PATENT DOCUMENTS

| | | | |
|---|---|---|---|
| JP | H08114183 | A | 5/1996 |
| JP | 2000241306 | A | 9/2000 |
| RU | 2165642 | C2 | 4/2001 |

OTHER PUBLICATIONS

International Search Report from the International Searching Authority for International Application No. PCT/US2014/029651 dated Aug. 20, 2014 (9 pages).

(Continued)

*Primary Examiner* — John Olszewski
*Assistant Examiner* — Gerrad A Foster
(74) *Attorney, Agent, or Firm* — Michael Best & Friedrich LLP

(57) ABSTRACT

A method of monitoring a fluid system of a mining machine. The method including sensing a pressure level of a fluid in the fluid system of the mining machine to generate pressure level data; analyzing the pressure level data to detect pressure level deviations; determining at least one selected from the group of when a frequency of the pressure level deviations exceeds a predetermined frequency, and when the fluid pressure level fails to reach a threshold within a predetermined reaction time period; and outputting an alert in response to the determination.

16 Claims, 6 Drawing Sheets

(56) References Cited

U.S. PATENT DOCUMENTS

| | | | | |
|---|---|---|---|---|
| 5,892,437 | A | 4/1999 | Scheibe et al. | |
| 6,070,698 | A * | 6/2000 | Wells | F16N 7/32 184/55.2 |
| 6,145,626 | A | 11/2000 | Niemczura et al. | |
| 6,213,820 | B1 * | 4/2001 | Kanno | F02B 61/045 440/1 |
| 6,469,638 | B1 * | 10/2002 | Johnson | G07C 5/008 340/438 |
| 6,470,247 | B1 | 10/2002 | Meyer et al. | |
| 7,009,508 | B2 | 3/2006 | Vertenten | |
| 7,599,775 | B2 | 10/2009 | Furuno | |
| 7,936,261 | B2 | 5/2011 | Rossaert | |
| 8,065,342 | B1 | 11/2011 | Borg et al. | |
| 8,073,653 | B2 | 12/2011 | Suzuki et al. | |
| 2002/0018724 | A1 | 2/2002 | Millet et al. | |
| 2002/0178780 | A1 * | 12/2002 | Van Mullekom | F01M 11/04 73/10 |
| 2002/0179375 | A1 * | 12/2002 | Suzuki | B21B 31/076 184/55.1 |
| 2004/0255656 | A1 | 12/2004 | Rafei | |
| 2005/0081410 | A1 * | 4/2005 | Furem | E02F 9/267 37/379 |
| 2005/0262838 | A1 | 12/2005 | Kageyama et al. | |
| 2006/0069484 | A1 * | 3/2006 | Thomson | B60W 30/18 701/50 |
| 2006/0176185 | A1 | 12/2006 | Ram et al. | |
| 2007/0116584 | A1 * | 5/2007 | DeRosa | F04B 39/16 417/442 |
| 2010/0030490 | A1 | 2/2010 | Wright et al. | |
| 2011/0254679 | A1 | 10/2011 | Todd et al. | |
| 2011/0300992 | A1 | 12/2011 | Richter et al. | |
| 2011/0301817 | A1 | 12/2011 | Hobenshield et al. | |
| 2012/0022762 | A1 | 1/2012 | Rosero | |
| 2012/0092150 | A1 | 4/2012 | Green et al. | |
| 2012/0092180 | A1 | 4/2012 | Rikkola et al. | |
| 2012/0232756 | A1 | 9/2012 | Yuan et al. | |
| 2013/0033090 | A1 | 2/2013 | Jokonya | |
| 2014/0277964 | A1 | 9/2014 | Rikkola et al. | |

OTHER PUBLICATIONS

Written Opinion from the International Searching Authority for International Application No. PCT/US2014/029651 dated Aug. 20, 2014 (6 pages).

Wu, Duqiang; Modeling and Experimental Evaluation of a Load-Sensing and Pressure Compensated Hydraulic System Thesis; University of Saskatchewan, Canada Department of Engineering, Dec. 11, 2004 (347 pages).

Apostolov, A.P.; Automatic Fault Analysis and User Notification for Predictive Maintenance; IEEE, 2006 (8 pages).

Written Opinion of the International Searching Authority for International Application No. PCT/US2014/016946 dated May 18, 2014 (4 pages).

International Search Report of the International Searching Authority for International Application No. PCT/US2014/016946 dated May 30, 2014 (7 pages).

M2 Presswire; Spectra and BSM Wireless Have Developed a Remote Air Brake Diagnostic and Monitoring Solution for the Trucking Industry; Filing Services Canada; dated Aug. 1, 2006 (3 pages).

Ke, X. et al ; A condition monitoring system of the disk brake based on nRF24L01; Electronic Measurement & Instruments (ICEMI) dated Aug. 2011.

Written Opinion of the International Searching Authority for International Application No. PCT/US2012/016946 dated May 30, 2014 (4 pages).

PCT/US2014/016946 Notification of Transmittal of International Preliminary Report on Patentability dated Mar. 2, 2015 (11 pages).

First Office Action from the Statement Intellectual Property Office of China for Application No. 201480000838.9 dated Aug. 17, 2016 (20 pages).

First Office Action from the Chilean Patent Office for Application No. 02684-2014 dated Sep. 15, 2016 (8 pages).

Second Office Action from the Chilean Patent Office for Application No. 02684-2014 dated Jan. 13, 2017 (8 pages, which includes a Statement of Relevance).

First Office Action from the Mexican Patent Office for Application No. MX/a/2014/006586 dated Jul. 7, 2017 (6 pages).

First Office Action from the Australian Patent Office for Application No. 2014202462 dated Jul. 3, 2017 (3 pages).

Russian Patent Office Decision to Grant for Application No. 2014134905 dated Apr. 4, 2018 (11 pages including English translation).

Indonesia Patent Office Action for Application No. P00201402976 dated Apr. 4, 2018 (3 pages including Statement of Relevance).

Third Chinese Patent Office Action for Application No. 201480000838.9 dated Oct. 9, 2017 (9 pages with English translation included).

Russian Patent Office Action for Application No. 2014134905 dated Dec. 7, 2017 (11 pages with English translation included).

Mexican Patent Office Action for Application No. MX/A/2014/006586 dated Jan. 12, 2018 (6 pages including English translation).

* cited by examiner

SYSTEMS AND METHODS FOR MONITORING A FLUID SYSTEM OF A MINING MACHINE

RELATED APPLICATION

The present application claims priority to U.S. Provisional Application 61/766,080, filed Feb. 18, 2013, the entire contents of which are hereby incorporated.

BACKGROUND

The present invention relates to an air and lubricant monitoring system for mining equipment, such as shovels.

SUMMARY

Finely-tuned air and lubricant systems provide optimal productivity and operation of mining equipment, such as a shovel. Accordingly, embodiments of the present invention monitor air pressure using either a pressure transducer or pressure switch. If the air pressure in the system drops below original equipment manufacturer ("OEM") specs for more than a predetermined period of time (e.g., approximately two seconds) during operation, a controller included in the shovel can initiate a delayed shutdown, which stops the shovel in approximately 30 seconds. Appropriate setting of the air pressure at the compressors and the behavior of the air system in combination with the shovel's brakes and lubricant systems help determine key performance indicators ("KPIs") for the shovel that can be used to manage the operation of the shovel.

In particular, specific trend behaviors of the air pressure system, brakes release indicators, brakes solenoids, brakes pressures, and lubricant systems can be recorded and analyzed. Oscillations or sizable drops in the air pressure are generally primary indicators of any anomaly in the air system or related components. The outliers are filtered while the machine is either in a shutdown sequence or in an idle mode that is determined by the machine's state digital signal codes. Essentially, the minimum setting is the first check point taken into consideration to begin with and prior to any digging into brakes and lubricant analytics.

Although observing and analyzing the air pressure system and the related subsystems in approximately real-time provides benefits, automatic predictive failure analysis provides additional advantages. In particular, condition-based equipment models ("CBEMs") can be used to predict and notify operators of any potential problems or failures. The condition based models look for specific changes in the functionality of the shovel and the related systems that might indicate the potential of a future problem or failure.

For example, brake set and release times are some of the characteristics the predictive model programs can analyze. For example, correlating anomalies in the air pressure with the delayed brakes release mechanisms on the hoist and crowd motions can help determine if the brakes air supply regulator needs to be adjusted. Historical data analysis indicates that it could take approximately 0.7 seconds to 1.2 seconds from the time an operator initiates a brake release function until the motion is halted. During this time, brakes supply regulator is presumed to be set around 100 PSIs. Although it would be nearly impossible for an analyst to actively monitor the brake system set and release times for slight changes, indicating a potential failure, the predictive models are analyzing this data continuously.

Similarly, the lubricant system, including the upper and lower open grease systems, are tied to the air system. Leaks in the lubricant system air supply, as well as, insufficient lubricant pressures and functionality can be analyzed and determined. As the time-series data is collected, statistical assessment with the historically-derived control parameters, help detect any deviation each time a dip or spike behavior is logged. For example, improper grease levels have been determined to be secondary indicators of improper functioning of the air and lubricant systems.

Monitoring the above mentioned KPIs and processing them in approximately real-time can detect out-of-normal settings and indiscernible changes. Advanced and early prognostics supported by proven diagnostics (e.g., based on access to a large amount of data different mechanical settings) further intensify the analytics. All of this functionality helps rule out the obvious, and not so obvious, in a prompt fashion, which reduces unwanted downtime resulting in loss of production.

Accordingly, one model (an air pressure model) is used to detect dips and spikes in pressure. An alert is generated based on both the amount of deviation from expected pressure level and the frequency of deviations in a timer period. Another model (a lubricant system pressure model) detects a dip in air pressure when lubricant action has activated. An alert is generated if the dip is excessive. Yet another model (a lubricant system cycle time model) determines if dips in air pressure occurring when lubricant action is activated remain for an excessive period of time. A further model (a lubricant system reaction time model) determines an amount of time it takes to reach appropriate pressure levels when lubricant action is activated. An alert is generated if the amount of time is excessive.

In one embodiment, the invention provides a mining machine including fluid system. The mining machine including a fluid pressure sensor operable to sense a pressure level of a fluid in the fluid system of the mining machine and a controller. The controller operable to analyze the pressure level to detect pressure level deviations; determine at least one selected from the group of when a frequency of the pressure level deviations exceeds a predetermined frequency, and when the fluid pressure level fails to reach a threshold within a predetermined reaction time period; and output an alert in response to the determination.

In another embodiment the invention provides a method of monitoring a fluid system of a mining machine. The method including sensing a pressure level of a fluid in the fluid system of the mining machine to generate pressure level data; analyzing the pressure level data to detect pressure level deviations; determining at least one selected from the group of when a frequency of the pressure level deviations exceeds a predetermined frequency, and when the fluid pressure level fails to reach a threshold within a predetermined reaction time period; and outputting an alert in response to the determination.

Other aspects of the invention will become apparent by consideration of the detailed description and accompanying drawings.

DETAILED DESCRIPTION

Figure 1:
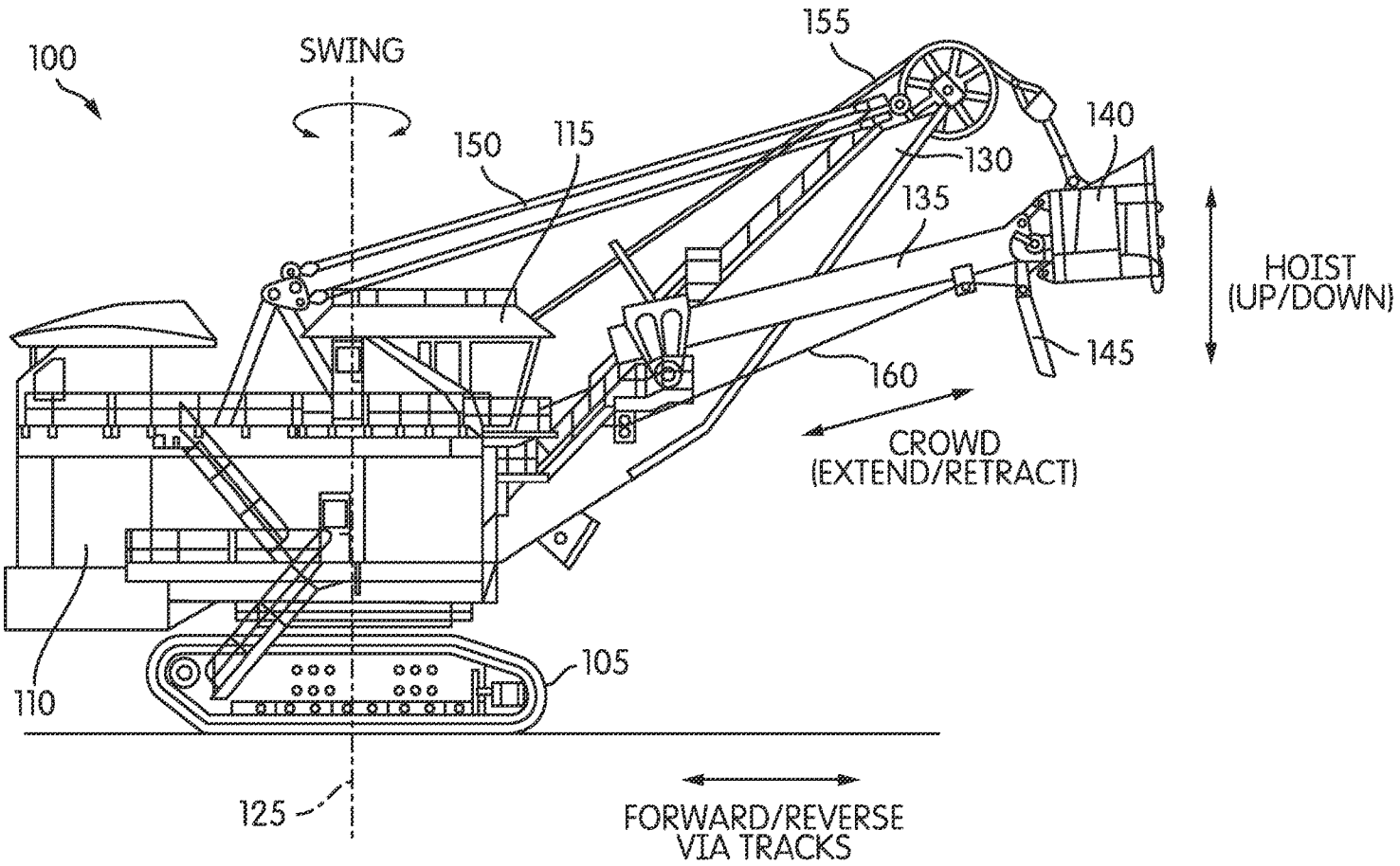
FIG. 1 illustrates a mining shovel according to an embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium). As such, it should be noted that a plurality of hardware and software based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

FIG. 1 illustrates a mining shovel 100, such as an electric mining shovel. The embodiment shown in FIG. 1 illustrates the mining machine as a rope shovel, however, in other embodiments the mining shovel 100 is a different type of mining machine, such as for example, a hybrid mining shovel, a dragline excavator, etc. The mining shovel 100 includes tracks 105 for propelling the rope shovel 100 forward and backward, and for turning the rope shovel 100 (i.e., by varying the speed and/or direction of the left and right tracks relative to each other). The tracks 105 support a base 110 including a cab 115. The base 110 is able to swing or swivel about a swing axis 125, for instance, to move from a digging location to a dumping location. Movement of the tracks 105 is not necessary for the swing motion. The rope shovel further includes a dipper shaft 130 supporting a pivotable dipper handle 135 (handle 135) and dipper 140. The dipper 140 includes a door 145 for dumping contents from within the dipper 140 into a dump location, such as a hopper or dump-truck.

The rope shovel 100 also includes taut suspension cables 150 coupled between the base 110 and dipper shaft 130 for supporting the dipper shaft 130; a hoist cable 155 attached to a winch (not shown) within the base 110 for winding the cable 155 to raise and lower the dipper 140; and a dipper door cable 160 attached to another winch (not shown) for opening the door 145 of the dipper 140. In some instances, the rope shovel 100 is a Joy Global Surface Mining® 4100 series shovel produced by Joy Global Inc., although the electric mining shovel 100 can be another type or model of mining equipment.

When the tracks 105 of the mining shovel 100 are static, the dipper 140 is operable to move based on three control actions, hoist, crowd, and swing. The hoist control raises and lowers the dipper 140 by winding and unwinding hoist cable 155. The crowd control extends and retracts the position of the handle 135 and dipper 140. In one embodiment, the handle 135 and dipper 140 are crowded by using a rack and pinion system. In another embodiment, the handle 135 and dipper 140 are crowded using a hydraulic drive system. The swing control swivels the handle 135 relative to the swing axis 125. Before dumping its contents, the dipper 140 is maneuvered to the appropriate hoist, crowd, and swing positions to 1) ensure the contents do not miss the dump location; 2) the door 145 does not hit the dump location when released; and 3) the dipper 140 is not too high such that the released contents would damage the dump location.

Figure 2:
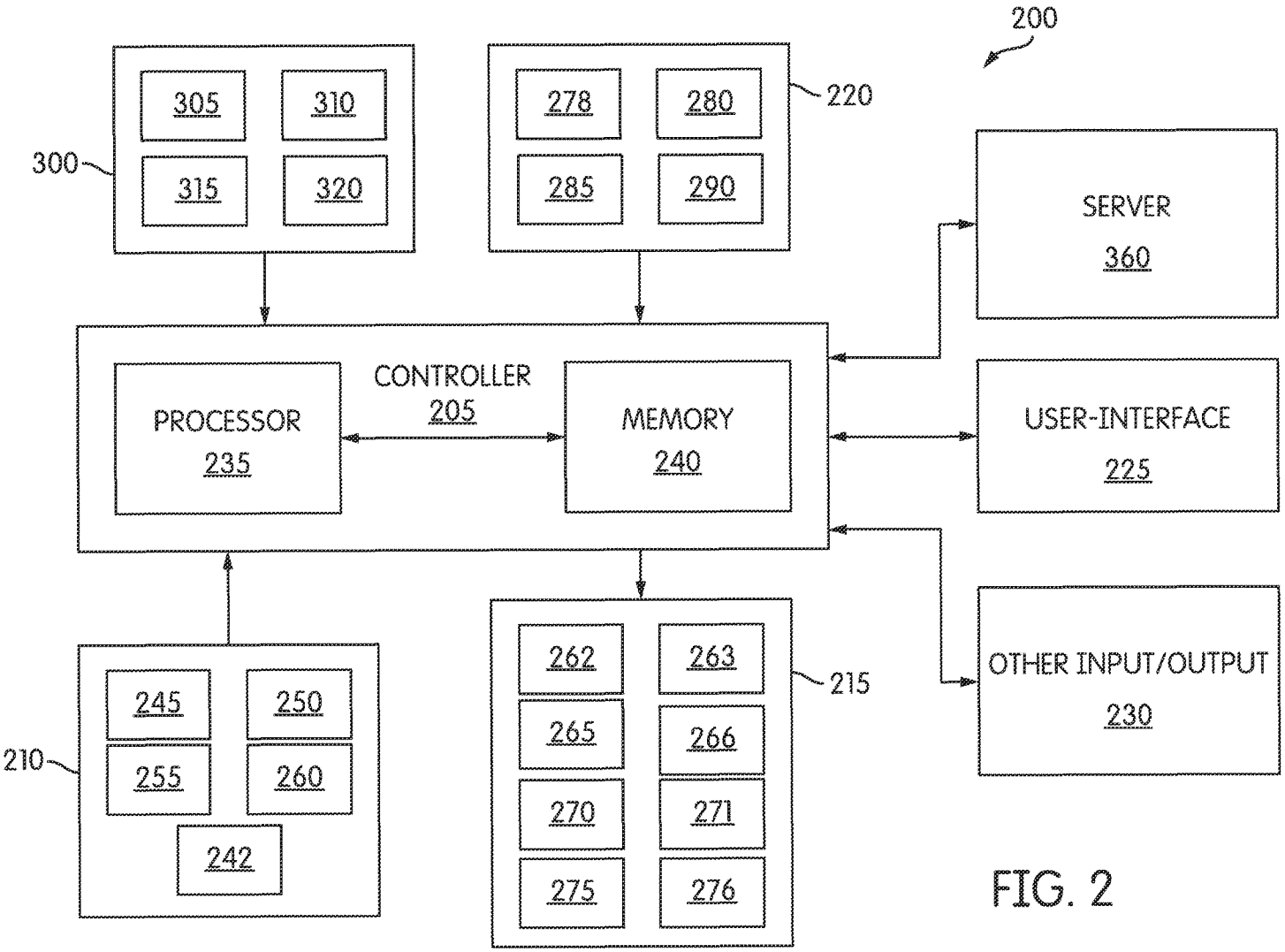
FIG. 2 illustrates a control system of the mining shovel of FIG. 1.

As shown in FIG. 2, the mining shovel 100 includes a control system 200. The control system 200 includes a controller 205, operator controls 210, mining shovel controls 215, sensors 220, a user-interface 225, and other input/outputs 230. The controller 205 includes a processor 235 and memory 240. The memory 240 stores instructions executable by the processor 235 and various inputs/outputs for, e.g., allowing communication between the controller 205 and the operator or between the controller 205 and sensors 220. The memory 240 includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD cark, or other suitable magnetic, optical, physical, or electronic memory devices. The processor 235 is connected to the memory 240 and executes software instructions that are capable of being stored in the memory 240. Software included in the implementation of the mining shovel 100 can be stored in the memory 240 of the controller 205. The software includes, for example, firmware, one or more applications, program data, filters, rules, one or more program modules, and other executable instructions. The controller 205 is configured to retrieve from memory 240 and execute (with the processor 235), among other things, instructions related to the control processes and methods described herein. In some instances, the processor 235 includes one or more of a microprocessor, digital signal processor (DSP), field programmable gate array (FPGA), application specific integrated circuit (ASIC), or the like. In some embodiments, the controller 205 also includes one or more input/output interfaces for interfacing with the operator controls 210, the mining shovel controls 215, the sensors 220, the user-interface 225, and the other input/outputs 230.

The controller 205 receives input from the operator controls 210. The operator controls 210 include a propel control 242, a crowd control 245, a swing control 250, a hoist control 255, and a door control 260. The propel control 242, crowd control 245, swing control 250, hoist control 255, and door control 260 include, for instance, operator controlled input devices such as joysticks, levers, foot pedals, and other actuators. The operator controls 210 receive operator input via the input devices and output digital motion commands to the controller 205. The motion commands include, for example, left track forward, left track reverse, right track forward, right track reverse, hoist up, hoist down, crowd extend, crowd retract, swing clockwise, swing counterclockwise, and dipper door release.

Upon receiving a motion command, the controller 205 generally controls mining shovel controls 215 as commanded by the operator. The mining shovel controls 215 include one or more propel motors 262, one or more crowd motors 265, one or more swing motors 270, and one or more hoist motors 275. The mining shovel controls 215 further include one or more propel brakes 263, one or more crowd brakes 266, one or more swing brakes 271, and one or more hoist brakes 276, which are used to decelerate the respective movements of the mining shovel 100. In some embodiments, the brakes are electrically controlled brakes (e.g., solenoid brakes). In embodiments where the brakes are solenoid brakes, a spring engages the brake when the solenoid is powered off, and the brake is disengaged, or released, when the solenoid is powered on. In other embodiments, the brakes are air brakes (e.g., compressed air brakes). In embodiments where the brakes are air brakes, compressed air is used to apply pressure to a brake pad. In other embodiments, the brakes include one or more solenoid brakes and one or more air brakes. For instance, if the operator indicates via swing control 250 to rotate the handle 135 counterclockwise, the controller 205 will generally control the swing motor 270 to rotate the handle 135 counterclockwise. Once the operator indicates via swing control 250 to decelerate the handle 135, the controller 205 will generally control the swing brake 271 to decelerate the handle 135. However, in some embodiments, the controller 205 is configured to limit the operator motion commands and generate motion commands independent of the operator input.

The controller 205 is also in communication with the sensors 220 to monitor the location and status of the dipper 140. For example, the controller 205 is in communication with one or more propel sensors 278, one or more crowd sensors 280, one or more swing sensors 285, and one or more hoist sensors 290. The propel sensors 278 indicate to the controller 205 data (e.g., position, speed, directions, etc.) concerning the tracks 105. The crowd sensors 280 indicate to the controller 205 the level of extension or retraction of the dipper 140. The swing sensors 285 indicate to the controller 205 the swing angle of the handle 135. The hoist sensors 290 indicate to the controller 205 the height of the dipper 140 based on the hoist cable 155 position. In other embodiments there are door latch sensors which, among other things, indicate whether the dipper door 145 is open or closed and measure the weight of a load contained in the dipper 140.

The mining shovel 100 further includes one or more fluid systems used to control, or maintain, machine health or functionality. For example, an air system 300 (FIG. 3) supplies compressed air to various areas or components of the mining shovel 100. Another example of a fluid system is a lubricant system 400 (FIG. 4), which supplies lubricant to various areas or components of the mining shovel 100. In some embodiments, the fluid systems pressurize fluid and supply the pressurized fluid to various components of the mining shovel 100. In other embodiments, the fluid system may include an air, oil, or water based cooling or hydraulic control system.

Figure 3:
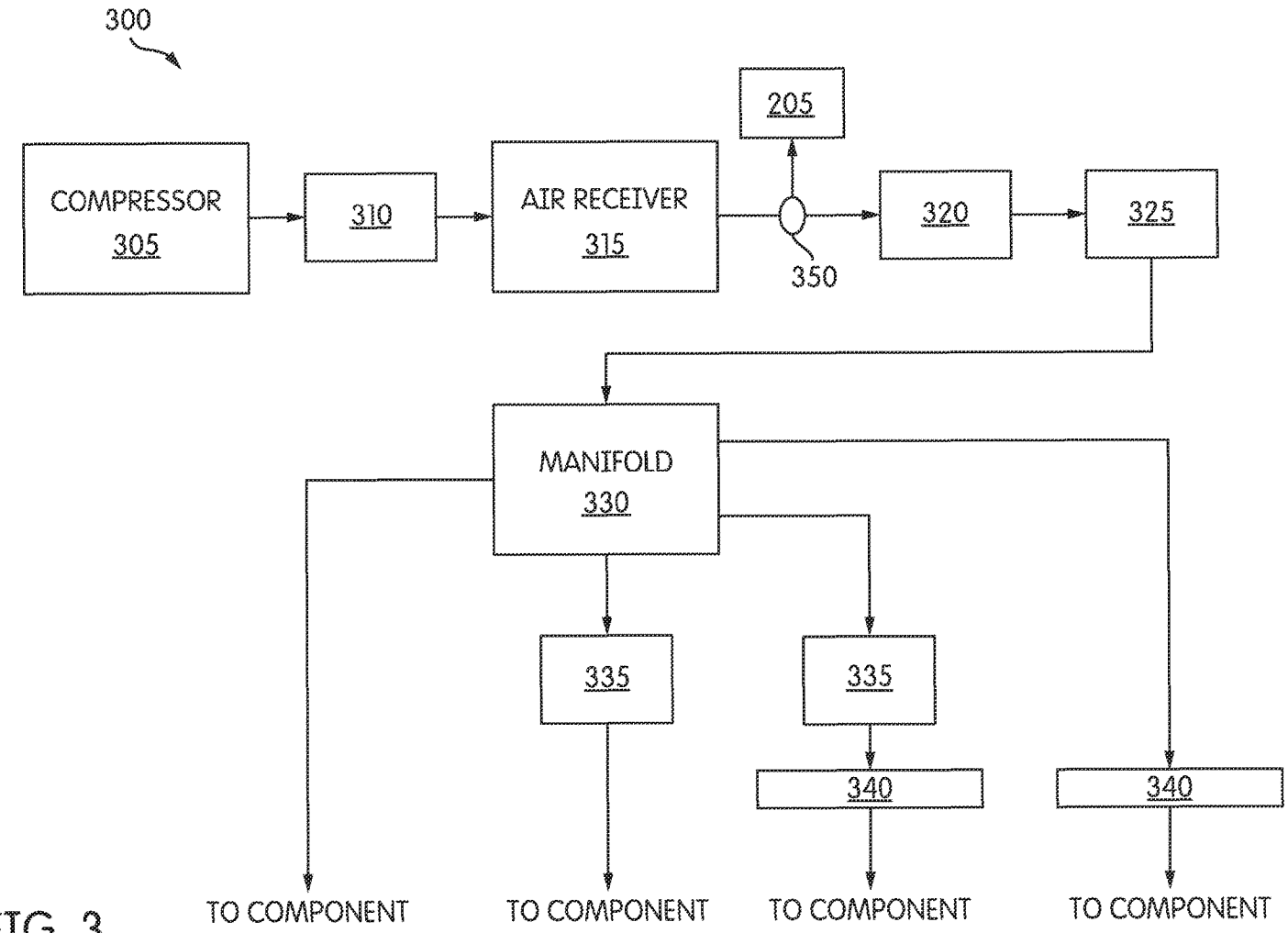
FIG. 3 illustrates an air system of the mining shovel of FIG. 1.

As shown in FIG. 3, the controller 205 is further in communication with an air system 300 (e.g., as one of the other input/outputs 230). The air system 300 supplies filtered, dried, and lubricated compressed air, as required, to all the air operated components of the mining shovel 100 (e.g., operator cab seat, air horns, air stair, lubricant pump air motors, lubricant system air sprayers, air brakes, air driven cable reel, a filtration system, etc.).

The air system 300 includes a compressor 305, an air dryer 310, an air receiver 315, one or more air valves 320, a lubricator 325, an air manifold 330, one or more air regulators 335, and a swivel 340. The variety of elements of the air system 300 are connected via a plurality of air lines. For example, in operation, the compressed air flows through the air system 300 to the various components via the air lines. The air lines and the direction of the flow therethrough are represented by the arrows connecting the plurality of elements of the air system 300 in FIG. 3. It should be understood that, in some embodiments, the air system 300 includes more or less elements.

The compressor 305 is an air compressor used to supply air to the air system 300. In some embodiments, the compressor 305 is a single compressor system. In other embodiments, the compressor 305 is a dual compressor system. The air dryer 310 removes moisture from the air supplied by the compressor 305 to prevent contamination within the air system 300. The air receiver 315 is a pressure vessel, or tank, used to store the air supplied by the compressor 305.

The one or more air valves 320 can include a variety of air valves, such as diaphragm valves, flow control valves, isolator valves, pilot valves, shutoff valves, or solenoid valves. Diaphragm valves contain a diaphragm, or membrane, that opens/closes the valve. Flow control valves are used to regulate the flow or pressure of air within the air system 300. Isolator valves are used to separate various components from the rest of the air system 300, in the case of failure or when maintenance is required on a component. Pilot valves allow high pressure or high flow systems to be controlled at a lower pressure or low flow. The shutoff valve is a valve that controls the on/off supply to the air system 300. In some embodiments, the mining shovel 100 includes more or less valves.

The lubricator 325 is used to add lubricant to the air, which is necessary for the moving parts of the various air valves and cylinders in the air system 300. The air manifold 330 branches the air from the air receiver 315 to various components of the mining shovel 100. The air regulators 335 are used to lower the air pressure from the air receiver 315 before the air is sent downstream to the various components. The swivel 340 is a mechanical joint that allows the upper portion of the mining shovel 100 to rotate about the lower portion of the mining shovel 100 without damaging various air hoses as well as electrical cabling running between the lower portion and the upper portion.

In operation, the compressor 305 compresses and pressurizes air into the air receiver 315. As the air is supplied to the air receiver 315, the air dryer 310 removes moisture from the air. The dry air is then supplied through the one or more valves 320. In some embodiments, there are other valves 320 placed in various positions of the air system 300. The dry air is then supplied through the lubricator 325, which adds lubricant to the air. The air is then branched out to the various components by the air manifold 330. If a component requires a lower air pressure, the air is sent through an air regulator 335 before reaching the component. If a component is located in the upper portion of the mining shovel 100, the air is passed through the swivel 340. If a component is located in the lower portion of the mining shovel 100, the air is not passed through the swivel 340. It should be understood that, in some embodiments, the various components of the air system 300 can be arranged in various configurations, and thus perform functionality in a different order that as noted above. For example, FIG. 3 illustrates air being transported to a component, a component through a regulator 335, a component through a regulator 335 and the swivel 340, and a component through the swivel 340.

The air system 300 further includes one or more air sensors 350 placed at various positions within the air system 300. In some embodiments, the air sensors 350 are transducers, which measure pressure levels and convert the pressure levels to electrical signals. For example, an air sensor 350 measures the air pressure of the air system 300. Although shown in FIG. 3 as being located between the air receiver 315 and air valves 320, in some embodiments, there are multiple air sensors 350 placed throughout the air system 300.

In some embodiments, the air sensors 350 are electrically connected to the controller 205 (e.g., as one of the other input/outputs 230). The controller 205 receives the electrical signal from the air sensors 350. In some embodiments, the controller 205 detects dips and spikes in the sensed air pressure of the air system 300 (e.g., using one or more condition-based equipment models ("CBEMs") noted above). The controller 205 determines if there is an issue, or a fault, with the sensed air pressure. If the controller 205 determines that there is an issue with the sensed air pressure, such as a current failure, or a possible future failure, the controller 205 indicates the issue to the operator via the user-interface 225.

In some embodiments, the controller 205 is further connected to a server 360 via a network (e.g., a local area network, a wide area network, a wireless network, the Internet, etc. or combinations thereof). The controller 205 outputs the sensed air pressure to the server 360. The server 360 detects dips and spikes in the sensed air pressure (e.g., using one or more CBEM) to determine if there is an issue. If there is an issue, the server 360 indicates the issue to the operator. In some embodiments the issue is indicated to the operator via the user-interface 225. In other embodiments, the server 360 indicates an issue to the operator via remote messaging (e.g., electronic mail). In other embodiments, the server 360 indicates an issue to a remote user-interface. In some embodiments, the issue is indicated to the operator via a variety of methods discussed above.

As an example, in some embodiments, the main air pressure of the air system 300 is detected via the air sensor 350. In such an embodiment, the controller 205 detects dips and spikes in the main air pressure of the air system 300. The controller 205 determines if there is an issue by calculating the deviation of the sensed air pressure from a first predetermined air pressure threshold (e.g., the OEM specs, approximately 110 psi for AC shovels, approximately 100 psi for DC shovels, etc.) along with the frequency of deviations in a predetermined air pressure time period. For example, the main air pressure is sensed every two seconds, if the sensed air pressure is below the first predetermined air pressure threshold over two consecutive readings an issue is detected. As another example, the main air pressure is sensed every two seconds, if the sensed air pressure falls below the first predetermined air pressure threshold a predetermined amount of times in a predetermined time period, an issue is detected. If the controller 205 determines that there is an issue with the main air pressure, the controller 205 outputs an indication, or an alert.

In some embodiments, the controller 205 determines if there is an issue, or fault, based on a plurality of factors. The factors include, but are not limited to: air system pressure, air system cycle time, and air system reaction time. The controller 205 may determine there is an issue if the sensed air pressure of the air system 300 goes above or below the first predetermined air pressure threshold. The controller 205 may further determine there is an issue if the air pressure of the air system 300 goes above or below a second predetermined air pressure threshold for a predetermined air pressure time period. The controller 205 may further determine there is an issue if, at the beginning of a lubricant cycle, the air pressure does not reach a third predetermined air pressure threshold within a predetermined air pressure reaction time period.

Figure 4:
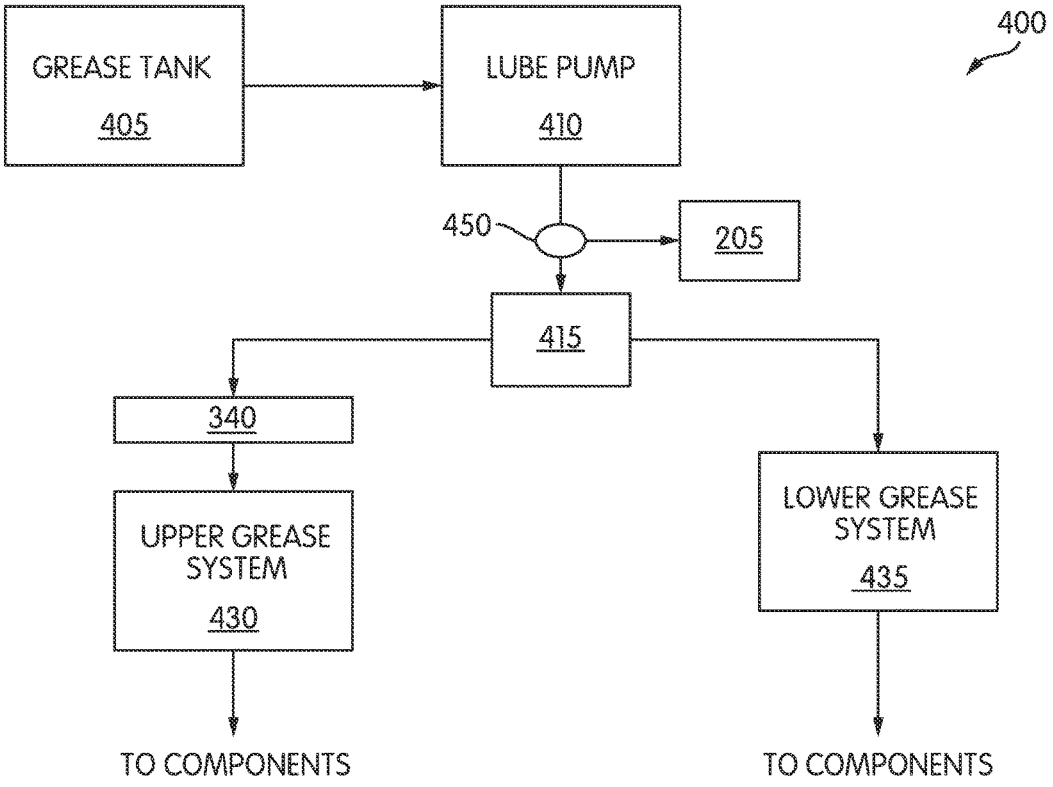
FIG. 4 illustrates a lubricant system of the mining shovel of FIG. 1.

As shown in FIG. 4, the controller 205 is further in communication with a lubricant system 400. In some embodiments, the controller 205 is electrically connected to the lubricant system 400 via the other input/output 230. The lubricant system 400 supplies lubricating grease (e.g., lubricant, etc.) to various components of the mining shovel 100 (e.g., boom point sheave, fleeting sheave, shipper shaft bushings, saddle block bushings, center gudgeon bushings and washers, swing shaft bearings, hoist drum sidestand bearings, boom foot pins, front and rear idler bushings, lower roller bushings, final drive shaft bearings and washers, handle rack and pinion, saddle block wear plates, boom wear plates, roller circle, ring gear, etc.). The lubricant flows through the lubricant system 400 to the various components of the mining shovel 100 via a plurality of grease, or lubricant lines. The lubricant lines and the direction of the flow therethrough are represented by the arrows connecting the plurality of elements of the lubricant system 400 in FIG. 4.

The lubricant system 400 includes one or more grease tanks 405, one or more lubricant pumps 410, one or more lubricant valves 415, and the swivel 340. In the embodiment shown in FIG. 4, the lubricant system 400 provides lubricant to an upper grease system 430 and a lower grease system 435. The upper grease system 430 includes the components of the mining shovel 100 that are located in the upper portion of the mining shovel 100. The lower grease system 435 includes components of the mining shovel 100 that are located in the lower portion of the mining shovel 100. In some embodiments, the lubricant system 400 includes more or less components.

The grease tank 405 is a vessel, or tank, for storing the lubricant of the lubricant system 400. The lubricant pump 410 is a pump for moving the lubricant from the grease tank 405 through the lubricant system 400. The one or more lubricant valves 415 include a variety of lubricant valves, such as, flow control valves, solenoid valves, vent valves, and zone control valves. The flow control valves are used to regulate the flow or pressure of the lubricant. The solenoid valves are valves that are controlled by electrical signals. The vent valves are solenoid valves that allow pressure in the lubrication zones to exhaust back to the grease tank 405. The zone control valves are solenoid valves that allow lubricant to flow to specific areas of the mining shovel 100. In some embodiments, the mining shovel includes four zones: the four zones including the upper grease zone, the lower grease zone, the upper open gear zone, and the lower open gear zone.

In some embodiments, each zone is lubricated according to a lubrication cycle. The lubrication cycle for each zone is set to run automatically as the timer for each cycle reaches its set point and additional prerequisites are met based on logic of the control system 200. The time between each cycle can be set according to a predetermined cycle time (e.g., one minute, three minutes, five minutes, ten minutes, fifteen minutes, thirty minutes, etc.). In some embodiments, the predetermined cycle time varies from zone to zone.

In operation, when a lubricant cycle begins, lubricant is pumped from the grease tank 405 by the lubricant pump 410. Various lubricant valves 415 are opened, for example but not limited to, by an electrical signal from the controller 200. In some embodiments, the lubricant valve 415 is one of the zone control valves, which open in order to allow lubricant to flow to the corresponding zone. In such an embodiment, the other zone control valves are normally closed and remain closed. The lubricant pump 410 then pumps the lubricant to the corresponding zone for the predetermined cycle time. The lubricant is then provided to the various components of the mining shovel 100 in the corresponding zone of upper grease system 430 or the lower grease system 435. In some embodiments, compressed air from the air system 300 is pushed through the opened lubricant valve 415 prior to lubricant being pumped through the corresponding opened lubricant valve 415. In some embodiments, after lubricant is provided to the various components, the lubricant is purged from the lubricant system 400 via compressed air from the air system 300. Excess lubricant from the various components flows through a vent valve back to the grease tank 405. A similar lubricant cycle for the remaining zones is then performed.

The lubricant system 400 further includes lubricant sensors 450 placed at various positions within the lubricant system 400. In some embodiments, the lubricant sensors 450 are transducers that measure pressure levels and convert the pressure levels to electrical signals. In some embodiments, the lubricant sensors 450 are ultrasonic transducers, which are used to measure distances. In some embodiments, lubricant sensor 450 measures a lubricant pressure of the lubricant system 400. Although shown in FIG. 4 as being located between the lubricant pump 410 and lubricant valves 415, in some embodiments, there are multiple air sensors 450 placed throughout the lubricant system 400.

In some embodiments, the lubricant sensors 450 are electrically connected to the controller 205 (e.g., as one of the other input/outputs 230). The controller 205 receives the electrical signal from the lubricant sensors 450. In some embodiments, the controller 205 detects dips and spikes in the sensed lubricant pressure of the lubricant system 400.

The controller 205 determines if there is an issue with the sensed lubricant pressure by monitoring the lubricant pressure, the lubricant system cycle time, and the lubricant system reaction time (e.g., using one or more CBEMs). The lubricant pressure is monitored for excessive dips or spikes, which may indicate an issue. The lubricant system cycle time is the period of time of a dip. If the time period of the dip is excessive, there may be an issue. The lubricant system reaction time is the amount of time for the lubricant system 400 to reach appropriate pressure levels. If the time is excessive there may be an issue. If the controller 205 determines that there is an issue with the sensed lubricant pressure, such as a current failure, or a possible future failure, the controller 205 indicates to the operator via the user-interface 225.

As noted above, in some embodiments, the controller 205 is further connected to the server 360. The controller 205 can output the sensed lubricant pressure to the server 360. The server 360 detects (e.g., using one or more CBEMs) dips and spikes in the sensed lubricant pressure to determine if there is an issue. If there is an issue, the server 360 indicates the issue to the operator. In some embodiments the issue is indicated to the operator via the user-interface 225. In other embodiments, the server 360 indicates an issue to the operator via remote messaging (e.g., electronic mail). In other embodiments, the server 360 indicates an issue to a remote user-interface. In some embodiments, the issue is indicated to the operator via a variety of methods discussed above.

As an example, in some embodiments, the lubricant pressure of the lubricant system 400 is detected via one or more lubricant sensors 450. In some embodiments, the lubricant pressure is not detected until after a predetermined time period (e.g., one minute, two minutes, three minutes, etc.) has surpassed after the start of a lubrication cycle. This allows for the lubricant pressure in the system to reach an upper limit set point (i.e., the OEM specs, approximately 1800 psi to 2400 psi for AC shovels).

Once the predetermined time period has surpassed, the controller 205 monitors the sensed lubricant pressure of the lubricant system 400. The controller 205 determines if there is an issue, or fault, based on a plurality of factors. The factors include, but are not limited to: lubricant system pressure, lubricant system cycle time, and lubricant system reaction time. The controller 205 may determine there is an issue if the sensed lubricant pressure of the lubricant system 400 goes above or below a first predetermined lubricant pressure threshold (i.e., lubricant system pressure). The controller 205 may further determine there is an issue if the lubricant pressure of the lubricant system 400 goes above or below a second predetermined lubricant pressure threshold for a predetermined lubricant cycle time period (i.e., lubricant pressure cycle time). The controller 205 may further determine there is an issue if, at the beginning of a lubricant cycle, the lubricant pressure does not reach the upper limit set point, discussed above, within a predetermined reaction time period (i.e., lubricant system reaction time).

In some embodiments, the controller 200 monitors the various issues at various states of the lubricant cycle. For example, upon starting the cycle, the controller 200 monitors at least the lubricant system reaction time. If the reaction time is unacceptable (i.e., it is determined that there is an issue) the mining shovel 100 shuts down, or the mining shovel 100 finishes the lubricant cycle and then shuts down.

If the reaction time is acceptable (i.e., it is determined there is not an issue), the controller 200 then monitors at least the lubricant system pressure and lubricant pressure cycle time. If three is an issue, the mining shovel 100 shuts down, or the mining shovel 100 finishes the lubricant cycle and then shuts down. If there is not an issue, the mining shovel 100 continues operation.

Figure 5:
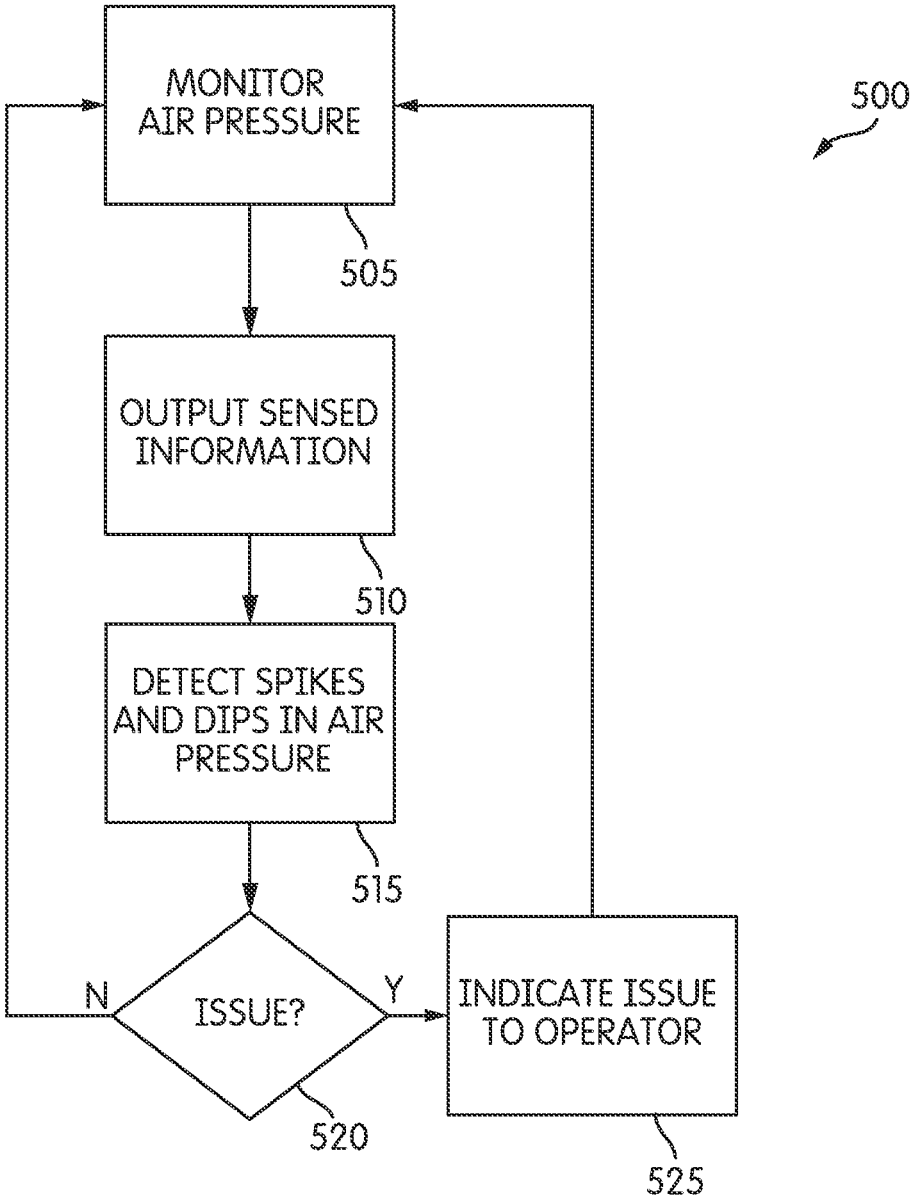
FIG. 5 illustrates an air pressure monitoring process or method according to an embodiment of the invention.

FIG. 5 illustrates an embodiment of an air pressure monitoring process or method 500. One or more air sensors 350 monitor the air pressure of the air system 300 (step 505). The air sensors 350 output the sensed data to the controller 205 (step 510). The controller 205 detects dips and spikes in the sensed air pressure (step 515). The controller 205 determines if there is an issue with the air pressure (step 520). If there is an issue, the controller 205 indicates the issue to the operator. After indicating the issue to the operator, or if there is not an issue, the controller 205 continues to monitor the air pressure of the air system 300 (at step 505).

Figure 6:
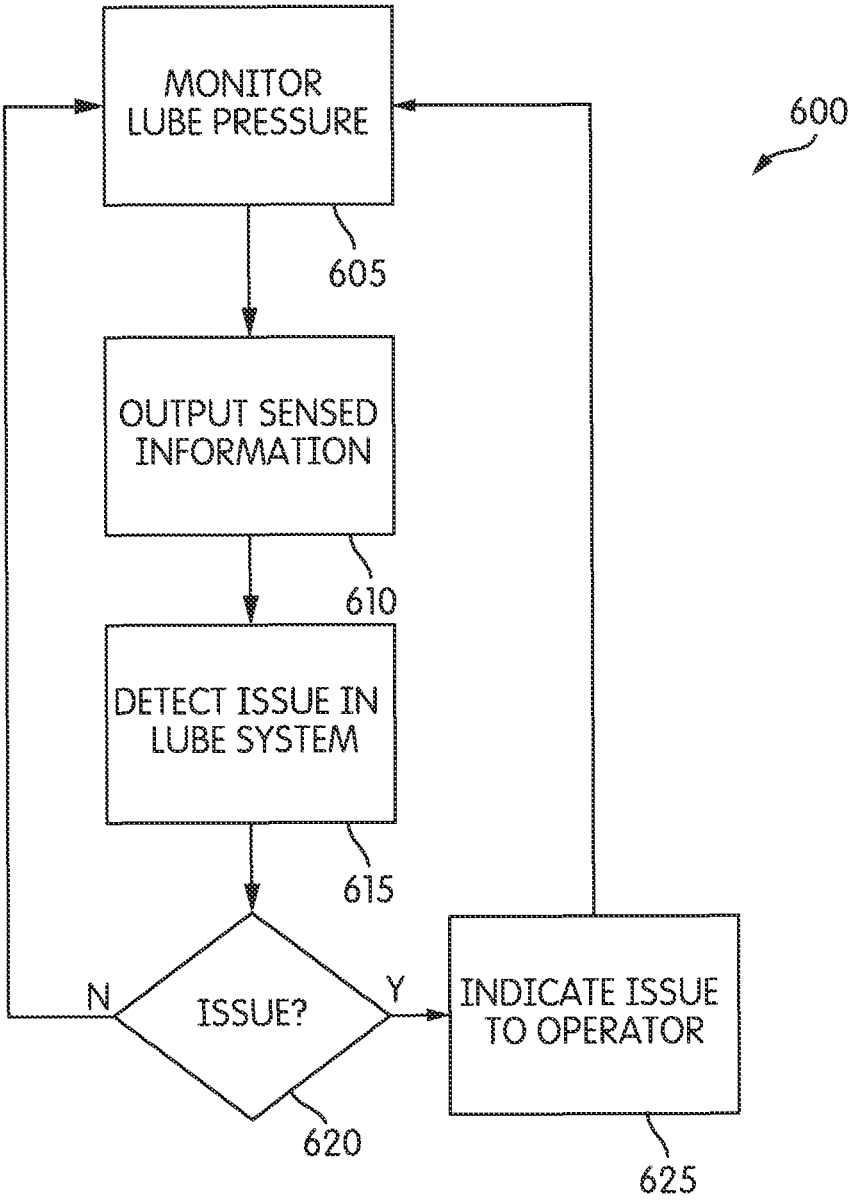
FIG. 6 illustrates a lubricant pressure monitoring process or method according to an embodiment of the invention.

FIG. 6 illustrates an embodiment of a lubricant pressure monitoring process or method 600. One or more lubricant sensors 450 monitor the lubricant pressure of the lubricant system 400 (step 605). The lubricant sensors 450 output the sensed data to the controller 205 (step 610). The controller 205 monitors the lubricant pressure, the lubricant system cycle time, and the lubricant system reaction time (step 615). The controller 205 determines if there is an issue with the air pressure (step 620). If there is an issue, the controller 205 indicates the issue to the operator. After indicating the issue to the operator, or if there is not an issue, the controller 205 continues to monitor the lubricant pressure of the lubricant system 400 (at step 605).

Thus, the invention provides, among other things, an air and lubricant monitoring system for a mining machine, such as a mining shovel. In particular, embodiments of the invention use CBEMs to predict and notify an operator of potential problems or failures. The condition-based models look for specific changes in the functionality of the shovel and the related systems that might indicate the potential of a future problem or failure. It should be understood that the CBEMs can be executed by the controller 205 included in the shovel 100 or can be executed by the server 360 in communication with the controller 205 over one or more wired or wireless connections. Accordingly, the monitoring and predictive functionality can be provided through the controller 205, the server 360, or a combination thereof.

In some embodiments, upon detection of an issue or fault, the controller 205 outputs an indication, or alert, which shuts down the mining shovel 100. In some embodiments, if a lubricant cycle is currently happening, the controller 205 waits until a lubricant cycle has completed before shutting down the mining shovel 100. In some embodiments, if a lubricant cycle has not started and the controller 205 detects an issue, the lubricant cycle will not begin.

Thus, the invention provides, among other things, a system and method of monitoring an air and lubricant system. Various features and advantages of the invention are set forth in the following claims.

What is claimed is:

1. A method of monitoring a lubricant system of a mining machine, the mining machine having an upper zone and a lower zone, the method comprising:
- initiating an upper lubricant cycle having an upper lubricant cycle time period, the upper lubricant cycle corresponding to the upper zone;
- initiating a lower lubricant cycle having a lower lubricant cycle time period, the lower lubricant cycle corresponding to the lower zone;
- sensing, at a predetermined time period after initiation of the upper and lower lubricant cycles, a upper pressure level of the lubricant in the upper zone and a lower pressure level of the lubricant in the lower zone;
- determining when the upper pressure level is below an upper threshold for the entire duration of the upper lubricant cycle time period;
- determining when the lower pressure level is below a lower threshold for the entire duration of the lower lubricant cycle time period; and
- outputting an alert in response to at least one selected from a group consisting of:
  - the upper pressure level being below the upper threshold for the entire duration of the upper lubricant cycle time period, and
  - the lower pressure level being below the lower threshold for the entire duration of the lower lubricant cycle time period.

2. The method of claim 1, further comprising
- determining when a frequency of pressure level deviations exceeds a predetermined frequency;
- wherein the pressure level deviation is a predetermined amount below or above an expected pressure level.

3. The method of claim 2, further comprising outputting a second alert based on the pressure level deviations.

4. The method of claim 1, further comprising injecting the lubricant into a fluid.

5. The method of claim 1, wherein the pressure level of the lubricant is sensed by one or more transducers.

6. The method of claim 1, wherein the analyzing is performed locally by a controller of the mining machine.

7. The method of claim 1, further comprising outputting the pressure level data to a remote server, wherein the remote server performs the analyzing of the pressure level data.

8. The method of claim 1, wherein outputting the alert performs one of shutting down the mining machine, communicating the alert to a network, and communicating the alert to an operator.

9. A mining machine including a lubricant system, the mining machine comprising:
- an upper zone;
- a lower zone:
- a lubricator configured to inject a lubricant into the upper zone during an upper lubricant cycle having an upper lubricant cycle time period and inject the lubricant into the lower zone during a lower lubricant cycle having a lower lubricant cycle time period;
- a fluid pressure sensor operable to sense an upper pressure level of the lubricant in the upper zone at an upper predetermined time period after initiation of the upper lubricant cycle and a lower pressure level of the lubricant in the lower zone at a lower predetermined time period after initiation of the lower lubricant cycle;
- a controller operable to
  - determine when the upper lubricant pressure level is below an upper threshold for the duration of the upper lubricant cycle time period,
  - determine when the lower pressure level is below a lower threshold for the entire duration of the lower lubricant cycle time period, and
  - output an alert in response to:
    - the upper pressure level being below the upper threshold for the entire duration of the upper lubricant cycle time period, and
    - the lower pressure level being below the lower threshold for the entire duration of the lower lubricant cycle time period.

10. The mining machine of claim 9, wherein the controller is further operable to
- determine when a frequency of pressure level deviations exceeds a predetermined frequency;
- wherein the pressure level deviation is a predetermined amount below or above an expected pressure level.

11. The mining machine of claim 10, wherein the controller is further operable to output a second alert based on the pressure level deviations.

12. The mining machine of claim 9, wherein the lubricant is injected into air.

13. The mining machine of claim 9, wherein the fluid pressure sensor is a transducer.

14. The mining machine of claim 9, wherein the controller is further operable to output the pressure level data to a remote server for analysis.

15. The mining machine of claim 14, wherein the pressure level data is wirelessly output to the remote server.

16. The mining machine of claim 9, wherein outputting the alert performs one of shutting down the mining machine, communicating the alert to a network, and communicating the alert to an operator.

* * * * *